US008372793B1

(12) United States Patent
Croce

(10) Patent No.: US 8,372,793 B1
(45) Date of Patent: Feb. 12, 2013

(54) SILVER CLEANING COMPOSITION

(75) Inventor: Scott M. Croce, East Brunswick, NJ (US)

(73) Assignee: Fifield, Inc., Hingham, MA (US)

( * ) Notice: Subject to any disclaimer, the term of this patent is extended or adjusted under 35 U.S.C. 154(b) by 170 days.

(21) Appl. No.: 12/911,629

(22) Filed: Oct. 25, 2010

Related U.S. Application Data

(60) Provisional application No. 61/255,019, filed on Oct. 26, 2009.

(51) Int. Cl.
*C11D 1/722* (2006.01)

(52) U.S. Cl. ..... 510/254; 510/202; 510/235; 510/245; 510/505; 510/506

(58) Field of Classification Search ..... 510/202, 510/235, 245, 254, 505, 506
See application file for complete search history.

(56) References Cited

U.S. PATENT DOCUMENTS

| | | | | |
|---|---|---|---|---|
| 4,851,148 | A * | 7/1989 | Yamasoe et al. | 134/3 |
| 4,861,374 | A * | 8/1989 | Eriksson | 510/256 |
| 6,896,739 | B1 * | 5/2005 | Croce | 134/2 |
| 7,037,379 | B2 | 5/2006 | Croce et al. | |
| 7,318,871 | B2 * | 1/2008 | Egan et al. | 134/42 |
| 7,811,387 | B2 * | 10/2010 | Scialla et al. | 134/25.2 |
| 2005/0121052 | A1 * | 6/2005 | Croce | 134/2 |
| 2006/0128585 | A1 * | 6/2006 | Adair et al. | 510/383 |

* cited by examiner

*Primary Examiner* — Gregory Webb
(74) *Attorney, Agent, or Firm* — Foley & Lardner LLP

(57) ABSTRACT

The present invention relates to a composition having tarnish-removing and soil-removing and preventing properties for cleaning a metal surface and methods of using the compositions.

22 Claims, No Drawings

SILVER CLEANING COMPOSITION

CROSS-REFERENCE TO RELATED APPLICATIONS

This application claims benefit of priority to U.S. Provisional Application No. 61/255,019 filed Oct. 26, 2009. The subject matter of which is incorporated in herein by reference in its entirety.

FIELD OF THE INVENTION

The present invention relates to a composition having tarnish-removing and soil-removing and preventing properties for cleaning a metal surface and methods of using the compositions.

BACKGROUND

Metals, such as silver, gold, copper, other noble metals and alloys thereof, are known to compile surface deposits and are thus easily soiled, dulled or tarnished due to exposure to environmental conditions or by handling and use. Products made from these metals are generally of high value and thus the cleaning and protection thereof is desired. However, such surface deposits can be difficult to remove without destroying the appearance or quality of the metal surface. For example, tarnish can be removed by mechanical cleaning methods using, for example, steel wool, sandpaper, emery paper, or a file to rub or polish the metal's dull surface. These mechanical cleaning methods cause scratching or marring of the surface. Chemical cleaners can visually change surface appearance. Cleaners and polishers are available, but involve substantial time and effort in application, are often difficult to use, tend to clean unevenly and fail often to remove all tarnish or prevent the reformation of an undesirable deposit on the surface.

Therefore, a need exists for a metal cleaning composition which removes surface deposits, such as soil and tarnish, from a metal surface rapidly and completely. In addition, it would be preferable that the metal cleaning composition also prevent the return of such surface deposits for a substantial time period, such as for at least two years.

SUMMARY OF THE INVENTION

The present invention is directed to a composition having tarnish removing and preventing properties for cleaning a metal surface and methods of using thereof.

Disclosed herein is an aqueous metal cleaning composition comprising:

water;
about 0.1 to about 5 weight percent of one or more transition metal salts;
about 1 to about 5 weight percent of a detergent;
about 0 to about 5 weight percent of thiourea; and
about 1 to about 5 weight percent of an acid;

wherein the weight percent is based on the total weight of the composition.

Also disclosed herein is an aqueous metal cleaning composition comprising:

water;
about 0.1 to about 5 weight percent of a transition metal salt;
about 1 to about 5 weight percent of a detergent;
about 0 to about 5 weight percent of thiourea; and
about 1 to about 5 weight percent of an acid;

wherein the weight percent is based on the total weight of the composition.

It is contemplated that the detergent in the aqueous metal cleaning composition acts synergistically with the other components of the composition, such that the metal which is being treated with the composition is able to withstand a hostile environment for an extended period of time. It is contemplated that the detergent assists in the removal of any oily deposits which would be on the surface of the tarnished metal, allowing the composition to have intimate contact with the surface of the metal, thus allowing the surface of the metal to be fully cleansed of tarnish.

Also disclosed herein is a method of cleaning a metal surface with an aqueous metal cleaning composition, said method comprising: contacting the metal surface with a composition comprising:

water;
about 0.1 to about 5 weight percent of one or more transition metal salts;
about 1 to about 5 weight percent of a detergent;
about 0 to about 5 weight percent of thiourea; and
about 1 to about 5 weight percent of an acid;

wherein the weight percent is based on the total weight of the composition.

Also disclosed herein is a method of cleaning a metal surface with an aqueous metal cleaning composition, said method comprising:

contacting the metal surface with a composition comprising:

water;
about 0.1 to about 5 weight percent of a transition metal salt;
about 1 to about 5 weight percent of a detergent;
about 0 to about 5 weight percent of thiourea; and
about 1 to about 5 weight percent of an acid;

wherein the weight percent is based on the total weight of the composition.

DETAILED DESCRIPTION OF THE INVENTION

Before the compositions and methods are described, it is to be understood that the invention is not limited to the particular methodologies and reagents described, as these may vary. It is also to be understood that the terminology used herein is intended to describe particular embodiments of the present invention, and is in no way intended to limit the scope of the present invention as set forth in the appended claims.

DEFINITIONS

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods, devices, and materials are now described. All publications cited herein are incorporated herein by reference in their entirety. Nothing herein is to be construed as an admission that the invention is not entitled to antedate such disclosure by virtue of prior invention.

It must be noted that as used herein and in the appended claims, the singular forms "a," "an," and "the" include plural references unless the context clearly dictates otherwise.

All numerical designations, e.g., pH, temperature, time, concentration, and molecular weight, including ranges, are approximations which are varied (+) or (−) by increments of 0.1. It is to be understood, although not always explicitly stated that all numerical designations are preceded by the term "about". The term "about" also includes the exact value "X" in addition to minor increments of "X" such as "X+0.1" or "X−0.1." It also is to be understood, although not always explicitly stated, that the reagents described herein are merely exemplary and that equivalents of such are known in the art.

As used herein, the term "comprising" is intended to mean that the compositions and methods include the recited elements, but do not exclude others. "Consisting essentially of" when used to define compositions and methods, shall mean excluding other elements of any essential significance to the combination when used for the intended purpose. Thus, a composition consisting essentially of the elements as defined herein would not exclude trace contaminants from the isolation and purification methods, such as solvents, preservatives, and the like. "Consisting of" shall mean excluding more than trace elements of other ingredients and substantial method steps for administering the compositions of this invention. Embodiments defined by each of these transition terms are within the scope of this invention.

As used herein, the term "metal surface" is intended to refer to a surface of a metal or metal alloy. It is contemplated that any metal or metal alloy can be cleaned using the compositions and methods disclosed herein. For example, it may be desirable to clean a metal that is easily tarnished, such as silver, copper, brass, silver, aluminum, gold, other noble metals and other semi-reactive metals and alloys thereof, to clean and/or prevent future tarnishing.

As used herein, the term "tarnish" is intended to refer to a layer of corrosion that forms over a metal as it undergoes oxidation. Tarnish is mainly caused by chemicals in the air, such as sulfur and/or oxygen and often appears as a usually dull, gray or black film or coat over the metal. As used herein, the term "substantially resists tarnishing" is intended to refer to preventing the formation of a layer of corrosion for a period of time. Specifically, "the metal substantially resists tarnishing for at least about two years," refers to almost no formation of a layer of corrosion for at least about 2 years.

As used herein, the term "contacting" is intended to refer to applying the composition to the metal surface. The composition can be applied in a variety of ways, including but not limiting to, dipping the metal surface into a container having the composition, rubbing the composition on the metal surface with a cloth, chamois, or other appropriate applicator, and rinsing the metal surface with the composition once or repeatedly until desired effect is achieved.

As used herein, the term "cleaning" is intended to refer to getting rid of dirt, soil, tarnish, etc. from the metal surface. For example, "cleaning" can include a rubbing and/or polishing of the metal surface with a cloth or other non-abrasive material.

As used herein, the term "removing" is intended to refer to washing or wiping off the used composition from the metal surface. As used herein, the term "used composition" is intended to refer to the aqueous metal cleaning composition which contains the contaminants from the metal surface after cleaning.

As used herein, the term "acid" is intended to refer to a compound that donates a proton in an aqueous solution. The acid can be a strong or weak acid or a combination thereof. For example, a strong acid, such as nitric acid, hydrochloric acid, sulfuric acid, trichloroacetic acid, trifluoroacetic acid and others, can be used in the compositions and methods disclosed herein. In addition, the acid composition can comprise a blend of strong acids, such as nitric acid and hydrochloric acid, wherein, for example, the weight ratio of nitric acid to hydrochloric acid is about 0.01 to about 1:1. It is also contemplated that weak acids can be used in the compositions and methods of the invention. Examples of weak acids include phosphoric acid, sulfamic acid, acetic acid, hydroxy acetic acid, citric acid, benzoic acid, tartaric acid, maleic acid, malic acid, fumaric acid, and the like.

As used herein, the term "thiourea" is intended to refer to $(NH_2)_2(C{=}S)$.

As used herein, the term "transition metal salt" is intended to refer a salt comprising the cation of one or more transition metal or a transition element and an anion. The transition metals are located in the d-block of the periodic table. Suitable transition metal salts for inclusion in the compositions and methods disclosed herein include, but are not limited to, cobalt salts, rhenium salts, iridium salts, chromium salts, molybdenum salts and tungsten salts. In addition, combinations of different salts including at least one metal salt of Group VI(b) and a metal salt of Group VIII can be used. Examples of such combinations include, but are not limited to, combinations of chromium and cobalt salts, combinations of molybdenum and rhenium salts and combinations of tungsten and iridium salts. It is contemplated that virtually any aqueous soluble anion can be used in the salt to attain the weight percentages of metal in solution. However, for convenience purposes, it is often helpful to use a salt anion that is the complementary anion to the acid used in the aqueous compositions. For example, if nitric acid is used as the acid material in the composition, a nitrate salt can be used. If, for example, a hydroxy acetic acid material is used as the acid, an acetic acid or hydroxy acetic acid salt can be used. Similarly, chloride can be used with HCl. Mixed salts can also be used with mixed acids.

As used herein, the term "detergent" is intended to refer to a composition intended to assist in the cleaning of the metal surface, and can include, for example, a surfactant. In certain embodiments, the detergent is a commercially available detergent, such as Micro-90, Micro A07, LF2100 or Surface Cleanse 930 (International Products Corporation). It is contemplated that the detergent can comprise any amphiphilic molecule, such as a cation, anion, Zwitterion or non-ionic molecule. Suitable anionic surfactants include, but are not limited to, those based on sulfate, sulfonate or carboxylate anions, such as perfluorooctanoate (PFOA or PFO), perfluorooctanesulfonate (PFOS), sodium dodecyl sulfate (SDS), ammonium lauryl sulfate, and other alkyl sulfate salts, sodium laureth sulfate, also known as sodium lauryl ether sulfate (SLES), alkyl benzene sulfonate and soaps or fatty acid salts. Suitable cationic surfactants include, but are not limited to, those based on quaternary ammonium cations, such as cetyl trimethylammonium bromide (CTAB, hexadecyl trimethyl ammonium bromide, and other alkyltrimethylammonium salts), cetylpyridinium chloride (CPC), polyethoxylated tallow amine (POEA), benzalkonium chloride (BAC) and benzethonium chloride (BZT). Suitable non-ionic surfactants include, but are not limited to, alkyl poly(ethylene oxides), alkylphenol poly(ethylene oxides), copolymers of poly(ethylene oxide) and poly(propylene oxide) (commercially called Poloxamers or Poloxamines), alkyl polyglucosides, such as octyl glucoside and decyl maltoside, fatty alcohols, such as cetyl alcohol and oleyl alcohol, cocamide MEA, cocamide DEA, and polysorbates, such as Tween 20 and Tween 80, which comprise dodecyl dimethylamine oxide. In one embodiment, the detergent comprises poly(oxy-1,2-ethanediyl), alpha-(undecyl)-omega-hydroxy (or 2-(undecyloxy)ethanol), which has the structure shown below:

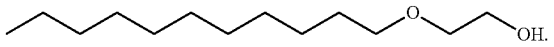

Compositions of the Invention

The present invention is directed to a composition having tarnish removing and preventing properties for cleaning a metal surface and methods of using thereof.

In one embodiment, the invention is directed to an aqueous metal cleaning composition comprising:

water;

about 1 to about 5 weight percent of one or more transition metal salts;

about 1 to about 5 weight percent of a detergent;

about 0 to about 5 weight percent of thiourea; and about 1 to about 5 weight percent of an acid;

wherein the weight percent is based on the total weight of the composition.

In another embodiment, the invention is directed to an aqueous metal cleaning composition comprising:

water;

about 0.1 to about 5 weight percent of a transition metal salt;

about 1 to about 5 weight percent of a detergent;

about 0 to about 5 weight percent of thiourea; and about 1 to about 5 weight percent of an acid;

wherein the weight percent is based on the total weight of the composition.

In one embodiment, the metal substantially resists tarnishing for at least about two years. It may be desirable to clean and/or prevent the tarnishing of a variety of metal surfaces, such as silver, copper, brass, silver, aluminum, gold, other noble metals and other semi-reactive metals and alloys thereof.

In certain embodiments, the composition comprises about 0.2 weight percent, or alternatively, about 0.4 weight percent, or alternatively, about 0.6 weight percent, or alternatively, about 0.8 weight percent, or alternatively, about 1 weight percent, or alternatively, about 1.2 weight percent, or alternatively, about 1.4 weight percent, or alternatively, about 1.6 weight percent, or alternatively, about 1.8 weight percent, or alternatively, about 2 weight percent of at least one transition metal salt. In one embodiment, the composition comprises only one transition metal salt. In one embodiment, the composition comprises about 1.8 weight percent of at least one transition metal salt. In some embodiments, there is from about 0.1 to about 1.5 weight percent of at least two transition metal salts. Suitable transition metal salts for inclusion in the compositions and methods disclosed herein include, but are not limited to, cobalt salts, rhenium salts, iridium salts, chromium salts, molybdenum salts, tungsten salts, and combinations thereof. In one embodiment, the transition metal salt comprises about an equal weight of a chromium salt and a cobalt salt. For example, in one embodiment, the composition comprises from about 0.9 weight percent to about 1.5 weight percent of a chromium salt and about 0.9 weight to about 1.5 weight percent of a cobalt salt. In a certain embodiment, the chromium salt is chromium nitrate. In a certain embodiment, the cobalt salt is cobalt nitrate.

In certain embodiments, the composition comprises about 1 weight percent, or alternatively, about 2 weight percent, or alternatively, about 3 weight percent, or alternatively, about 4 weight percent, or alternatively, about 4.5 weight percent, or alternatively, about 5 weight percent acid. In one embodiment, the composition comprises about 3 weight percent acid. The acid can be a strong or weak acid or a combination thereof. For example, a strong acid, such as nitric acid, hydrochloric acid, sulfuric acid, trichloroacetic acid, trifluoroacetic acid and others, can be used in the compositions and methods disclosed herein. In addition, the acid can comprise a blend of strong acids, such as nitric acid and hydrochloric acid, wherein, for example, the weight ratio of nitric acid to hydrochloric acid is about 0.01 to about 1:1. It is also contemplated that weak acids can be used in the compositions and methods of the invention. Examples of weak acids include phosphoric acid, sulfamic acid, acetic acid, hydroxy acetic acid, citric acid, benzoic acid, tartaric acid, maleic acid, malic acid, fumaric acid, and the like. In one embodiment, the acid is nitric acid. In another embodiment, the acid is aqueous nitric acid. In another embodiment, the acid is 70% aqueous nitric acid.

For convenience purposes, it is often helpful to use a salt anion that is the complementary anion to the acid used in the aqueous compositions. For example, if nitric acid is used as the acid material in the composition, a nitrate salt can be used. If, for example, a hydroxy acetic acid material is used as the acid, an acetic acid or hydroxy acetic acid salt can be used. Similarly, chloride and be used with HCl. Mixed salts can also be used with mixed acids.

In certain embodiments, the composition comprises about 1 weight percent, or alternatively, about 2 weight percent, or alternatively, about 3 weight percent, or alternatively, about 4 weight percent, or alternatively, about 5 weight percent thiourea. In one embodiment, the composition comprises about 4 weight percent thiourea. In another embodiment, the composition comprises about 4.5 weight percent thiourea.

In certain embodiments, the composition comprises about 1 weight percent, or alternatively, about 2 weight percent, or alternatively, about 3 weight percent, or alternatively, about 4 weight percent, or alternatively, about 5 weight percent detergent. In one embodiment, the detergent comprises about 3 weight percent. In certain embodiments, the detergent is a commercially available detergent, such as Micro-90, Micro A07, LF2100 or Surface Cleanse 930 (International Products Corporation). It is contemplated that the detergent can comprise any amphiphilic molecule, such as a cation, anion, Zwitterion or non-ionic molecule. Suitable anionic surfactants include, but are not limited to, those based on sulfate, sulfonate or carboxylate anions, such as perfluorooctanoate (PFOA or PFO), perfluorooctanesulfonate (PFOS), sodium dodecyl sulfate (SDS), ammonium lauryl sulfate, and other alkyl sulfate salts, sodium laureth sulfate, also known as sodium lauryl ether sulfate (SLES), alkyl benzene sulfonate and soaps or fatty acid salts. Suitable cationic surfactants include, but are not limited to, those based on quaternary ammonium cations, such as cetyl trimethylammonium bromide (CTAB, hexadecyl trimethyl ammonium bromide, and other alkyltrimethylammonium salts), cetylpyridinium chloride (CPC), polyethoxylated tallow amine (POEA), benzalkonium chloride (BAC) and benzethonium chloride (BZT). Suitable non-ionic surfactants include, but are not limited to, alkyl poly(ethylene oxides), alkylphenol poly(ethylene oxides), copolymers of poly(ethylene oxide) and poly(propylene oxide) (commercially called Poloxamers or Poloxamines), alkyl polyglucosides, such as octyl glucoside and decyl maltoside, fatty alcohols, such as cetyl alcohol and oleyl alcohol, cocamide MEA, cocamide DEA, and polysorbates, such as Tween 20 and Tween 80, which comprise dodecyl dimethylamine oxide. In one embodiment, the detergent is poly(oxy-1,2-ethanediyl), alpha-(undecyl)-omega-hydroxy (or 2-(undecyloxy)ethanol), which has the structure shown below:

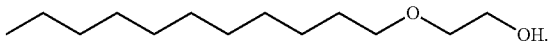

It is contemplated that the detergent in the aqueous metal cleaning composition acts synergistically with the other components of the composition, such that the metal which is being treated with the composition is able to withstand a hostile environment for an extended period of time. The composition disclosed herein allows for both the a) expeditious removal of tarnish deposits on silver and gold jewelry, and b) to protect against future tarnishing. In order to accomplish a), a solution was prepared composed of nitric acid, thiourea, water, cobalt nitrate, chromium nitrate and a surface cleansing detergent to assure intimate contact of the solution with the surface of the metal to be cleansed of tarnish. It is contemplated that the detergent assists in the removal of any oily deposits on the surface of the tarnished metal, such as would be deposited from handling jewelry and the like, by allowing the composition to have intimate contact with the surface of the metal. See Example 2.

In one embodiment, the invention is directed to an aqueous metal cleaning composition comprising:

water;

about 0.9 weight percent of a chromium salt;

about 0.9 weight percent of a cobalt salt;

about 2 weight percent of a detergent comprising poly (oxy-1,2-ethanediyl), alpha-(undecyl)-omega-hydroxy;

about 4 weight percent of thiourea; and about 3 weight percent of an acid;

wherein the weight percent is based on the total weight of the composition.

In another embodiment, the invention is directed to an aqueous metal cleaning composition comprising:

water;

about 0.25 weight percent of a chromium salt;

about 2 weight percent of a detergent comprising poly (oxy-1,2-ethanediyl), alpha-(undecyl)-omega-hydroxy;

about 4.5 weight percent of thiourea;

about 3 weight percent of 70% aqueous nitric acid; and about 0.5 weight percent of fragrance;

wherein the weight percent is based on the total weight of the composition.

Methods of the Invention

In one embodiment, the invention is directed to a method of cleaning a metal surface with an aqueous metal cleaning composition, said method comprising:

contacting the metal surface with a composition comprising:

water;

about 0.1 to about 5 weight percent of one or more transition metal salts; about 1 to about 5 weight percent of a detergent;

about 0 to about 5 weight percent of thiourea; and about 1 to about 5 weight percent of an acid;

wherein the weight percent is based on the total weight of the composition.

In one embodiment, the invention is directed to a method of cleaning a metal surface with an aqueous metal cleaning composition, said method comprising:

contacting the metal surface with a composition comprising:

water;

about 0.1 to about 5 weight percent of a transition metal salt;

about 1 to about 5 weight percent of a detergent;

about 0 to about 5 weight percent of thiourea; and about 1 to about 5 weight percent of an acid;

wherein the weight percent is based on the total weight of the composition.

In one embodiment, the metal substantially resists tarnishing for at least about two years. It may be desirable to clean and/or prevent the tarnishing of a variety of metal surfaces, such as silver, copper, brass, silver, aluminum, gold, other noble metals and other semi-reactive metals and alloys thereof. In one embodiment, the metal surface comprises silver.

The methods disclosed herein may also be performed using any of the compositions disclosed herein.

In one embodiment, the invention is directed to a method of cleaning a metal surface with an aqueous metal cleaning composition, said method comprising:

contacting the metal surface with a composition comprising:

water;

about 0.9 weight percent of a chromium salt;

about 0.9 weight percent of a cobalt salt;

about 2 weight percent of a detergent comprising poly (oxy-1,2-ethanediyl), alpha-(undecyl)-omega-hydroxy;

about 4 weight percent of thiourea; and about 3 weight percent of an acid;

wherein the weight percent is based on the total weight of the composition.

In one embodiment, the method further comprises removing the composition from the metal surface.

In another embodiment, the invention is directed to a method of cleaning a metal surface with an aqueous metal cleaning composition, said method comprising:

contacting the metal surface with a composition comprising:

water;

about 0.25 weight percent of a chromium salt;

about 2 weight percent of a detergent comprising poly (oxy-1,2-ethanediyl), alpha-(undecyl)-omega-hydroxy;

about 4.5 weight percent of thiourea;

about 3 weight percent of 70% aqueous nitric acid; and about 0.5 weight percent of fragrance;

wherein the weight percent is based on the total weight of the composition.

In one embodiment, the method further comprises removing the composition from the metal surface.

EXAMPLES

The invention is further understood by reference to the following example, which is intended to be purely exemplary of the invention. The present invention is not limited in scope by the exemplified embodiments, which are intended as illustrations of single aspects of the invention only. Any methods that are functionally equivalent are within the scope of the invention. Various modifications of the invention in addition to those described herein will become apparent to those skilled in the art from the foregoing description.

Example 1

| Component | Weight Percent |
|---|---|
| Water | 89.2 |
| Nitric acid | 3.0 |
| Thiourea | 4.0 |
| Detergent | 2.0 |
| Chromium nitrate | 0.9 |
| Cobalt nitrate | 0.9 |

First, water and nitric acid are combined in a suitable receptacle, followed by the addition of thiourea. This order of addition ensures proper solvation of thiourea. The remaining components listed above are then added to the composition.

Example 2

The following study was performed to determine the relative efficacy of four different detergents when used in the cleaning composition disclosed herein.

Test Materials:

1. Sterling silver plates of a known alloy composition, measuring 1½ inches×1½ inches×0.040 inches, polished to a mirror finish and cleansed of any surface contamination with 91% isopropanol. These were severely tarnished to a blackened surface by exposure to high levels of hydrogen sulfide gas.
2. A 5% solution of olive oil in n-butyl alcohol.
3. Four solutions of the tarnish-removal composition, each prepared with 2% of one of the following detergents: Micro-90, LF2100, Micro A07, and Surface Cleanse 930 (International Products Corporation).
5. One solution of the tarnish-removal composition, containing no detergent, as a control.

Each of the tarnished sterling plates was immersed in the oil-butanol solution, removed, and the alcohol allowed to evaporate, leaving only the oil on the surface. The plate was then immersed in one of the tarnish removal solutions, and the length of time recorded for the plate to become tarnish-free and brightened to the level of a standard polished plate. This was repeated for each of the detergents in the tarnish-removal compositions as well as the control. The test was repeated three times to assure accuracy of results (trials A, B and C, below).

| Detergent | Trial | Time for Tarnish Removal (seconds) |
|---|---|---|
| Micro-90 | A | 8 |
| | B | 10 |
| | C | 11 |
| LF2100 | A | 16 |
| | B | 18 |
| | C | 15 |
| Micro A07 | A | 5 |
| | B | 4 |
| | C | 5 |
| Surface Cleanse 930 | A | 19 |
| | B | 21 |
| | C | 17 |
| Control | A | 72 |
| | B | 58 |
| | C | 77 |

When the metal plates were treated in the control, the tarnish coating on the surface of the plates was not evenly removed. Areas remained on the plates that had not been sufficiently contacted by the solution to remove the tarnish completely.

It is apparent that the inclusion of a detergent in the composition results in a much shorter length of time required for the detergent in the composition to remove the oil film from the metal plates and allow the tarnish-removing chemical reaction to take place.

Example 3

| Component | Weight Percent |
|---|---|
| Water | 89.75 |
| Nitric acid (70%) | 3.0 |
| Thiourea | 4.5 |
| Detergent | 2.0 |
| Chromium nitrate | 0.25 |
| Fragrance | 0.5 |

As described above for example 1, water and nitric acid are combined first in a suitable receptacle, followed by the addition of thiourea. This order of addition ensures proper solvation of thiourea. The remaining components listed above are then added to the composition.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An aqueous metal cleaning composition comprising:
water;
about 0.1 to about 5 weight percent of a transition metal salt;
about 1 to about 5 weight percent of a detergent comprising poly(oxy-1,2-ethanediyl), alpha-(undecyl)-omega-hydroxy;
about 0 to about 5 weight percent of thiourea; and
about 1 to about 5 weight percent of an acid;
wherein the weight percent is based on the total weight of the composition.

2. The composition of claim 1, wherein the composition comprises about 0.2 weight percent of the transition metal salt.

3. The composition of claim 2, wherein the transition metal salt is a chromium salt.

4. The composition of claim 1, wherein the composition comprises about 4 weight percent thiourea.

5. The composition of claim 1, wherein the composition comprises about 2 weight percent detergent.

6. The composition of claim 1, wherein the composition comprises about 3 weight percent acid.

7. The composition of claim 6, wherein the acid is 70% aqueous nitric acid.

8. An aqueous metal cleaning composition comprising:
water;
about 0.25 weight percent of a chromium salt;
about 2 weight percent of a detergent comprising poly (oxy-1,2-ethanediyl), alpha-(undecyl)-omega-hydroxy;
about 4.5 weight percent of thiourea;
about 3 weight percent of 70% aqueous nitric acid; and about 0.5 weight percent of fragrance;

wherein the weight percent is based on the total weight of the composition.

9. A method of cleaning a metal surface with an aqueous metal cleaning composition, said method comprising;

contacting the metal surface with a composition comprising:

water;

about 0.1 to about 5 weight percent of a transition metal salt; about 1 to about 5 weight percent of a detergent comprising poly(oxy-1,2-ethanediyl), alpha-(undecyl)-omega-hydroxy;

about 0 to about 5 weight percent of thiourea; and about 1 to about 5 weight percent of an acid;

wherein the weight percent is based on the total weight of the composition.

10. The method of claim 9, further comprising removing used composition from the metal surface.

11. The method of claim 9, wherein the metal substantially resists tarnishing for at least about two years.

12. The method of claim 9, wherein the composition comprises about 0.2 weight percent of one or more transition metal salts.

13. The method of claim 12, wherein the transition metal salt is a chromium salt.

14. The method of claim 9, wherein the composition comprises about 4 weight percent thiourea.

15. The method of claim 9, wherein the composition comprises about 2 weight percent detergent.

16. The method of claim 15, wherein the detergent consists of poly(oxy-1,2-ethanediyl), alpha-(undecyl)-omega-hydroxy.

17. The method of claim 9, wherein the composition comprises about 3 weight percent acid.

18. The method of claim 17, wherein the acid is 70% aqueous nitric acid.

19. The method of claim 9, wherein the metal surface comprises silver.

20. A method of cleaning a metal surface with an aqueous metal cleaning composition, said method comprising;

contacting the metal surface with a composition comprising:

water;

about 0.25 weight percent of a chromium salt;

about 2 weight percent of a detergent comprising poly (oxy-1,2-ethanediyl), alpha-(undecyl)-omega-hydroxy;

about 4.5 weight percent of thiourea;

about 3 weight percent of 70% aqueous nitric acid; and about 0.5 weight percent of fragrance;

wherein the weight percent is based on the total weight of the composition.

21. The method of claim 20, further comprising removing the composition from the metal surface.

22. The composition of claim 1, wherein the detergent consists of poly(oxy-1,2-ethanediyl), alpha-(undecyl)-omega-hydroxy.

* * * * *